US006889678B1

(12) United States Patent
Oltmann

(10) Patent No.: US 6,889,678 B1
(45) Date of Patent: May 10, 2005

(54) COIN CATAPULT DEVICE FOR USE IN AN AMUSEMENT GAME

(76) Inventor: J. Richard Oltmann, 7759 S. Harlem Ave., Burbank, IL (US) 60459

( * ) Notice: Subject to any disclaimer, the term of this patent is extended or adjusted under 35 U.S.C. 154(b) by 0 days.

(21) Appl. No.: 10/790,415

(22) Filed: Mar. 1, 2004

Related U.S. Application Data

(60) Provisional application No. 60/451,798, filed on Mar. 4, 2003.

(51) Int. Cl.[7] ..... F41B 3/03

(52) U.S. Cl. ..... 124/7; 124/6; 124/16; 124/36

(58) Field of Search ..... 124/4, 6, 7, 16, 124/36

(56) References Cited

U.S. PATENT DOCUMENTS

| | | | | |
|---|---|---|---|---|
| 2,192,096 A | | 2/1940 | Minger | |
| 2,520,460 A | | 8/1950 | Ford | |
| 3,406,674 A | * | 10/1968 | Zone | 124/7 |
| 3,724,855 A | | 4/1973 | Chu | |
| 3,794,325 A | | 2/1974 | Stender | |
| 4,089,525 A | | 5/1978 | Palazzolo | |
| 4,245,842 A | | 1/1981 | Kuna et al. | |
| 4,303,248 A | | 12/1981 | Shoemaker, Jr. et al. | |
| 4,371,171 A | | 2/1983 | Silverman et al. | |
| 4,487,414 A | | 12/1984 | Karkkainen et al. | |
| 4,496,160 A | | 1/1985 | Wichinsky et al. | |
| 4,583,743 A | | 4/1986 | Macek | |
| 4,744,566 A | | 5/1988 | Malavazos et al. | |
| 4,759,551 A | | 7/1988 | Crompton | |
| 5,417,435 A | | 5/1995 | Peretz | |
| 5,501,466 A | | 3/1996 | Welch et al. | |
| 5,660,386 A | * | 8/1997 | Krieger | 124/7 |
| 6,644,292 B1 | * | 11/2003 | Ganson | 124/7 |
| 6,655,370 B1 | * | 12/2003 | Beckwith | 124/16 |

* cited by examiner

*Primary Examiner*—John A. Ricci
(74) *Attorney, Agent, or Firm*—Andrus, Sceales, Starke & Sawall, LLP

(57) ABSTRACT

A catapult device for hurling objects towards a target includes a support structure and a pivot bracket pivotally mounted on the support structure and provided with a bearing arrangement. A lever arm is pivotally connected to the support structure and is engageable with the pivot bracket. A spring-biased motion translation arrangement is coupled to the lever arm and is engageable with the bearing arrangement on the pivot bracket. A pivot arm is pivotally secured to the support structure and the motion translation arrangement. The pivot arm is provided with a receiver for holding an object to be hurled. Pivotal movement of the lever arm develops a spring force in the motion translation arrangement and enables the pivot bracket to pivot such that the motion translation arrangement moves along the bearing arrangement, and releases the spring force causing the pivot arm to swing and hurl the object.

20 Claims, 9 Drawing Sheets

FIG. 1
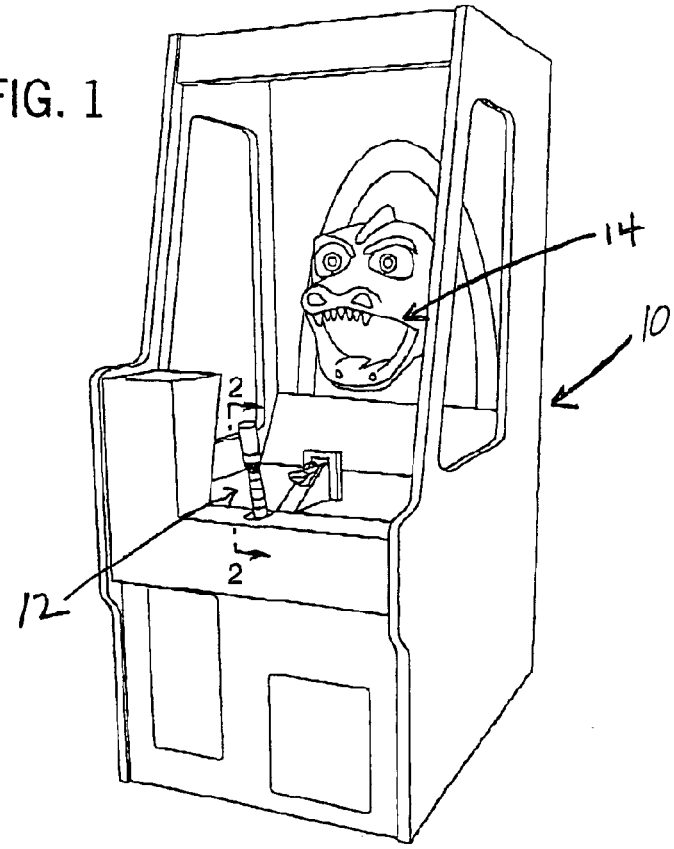
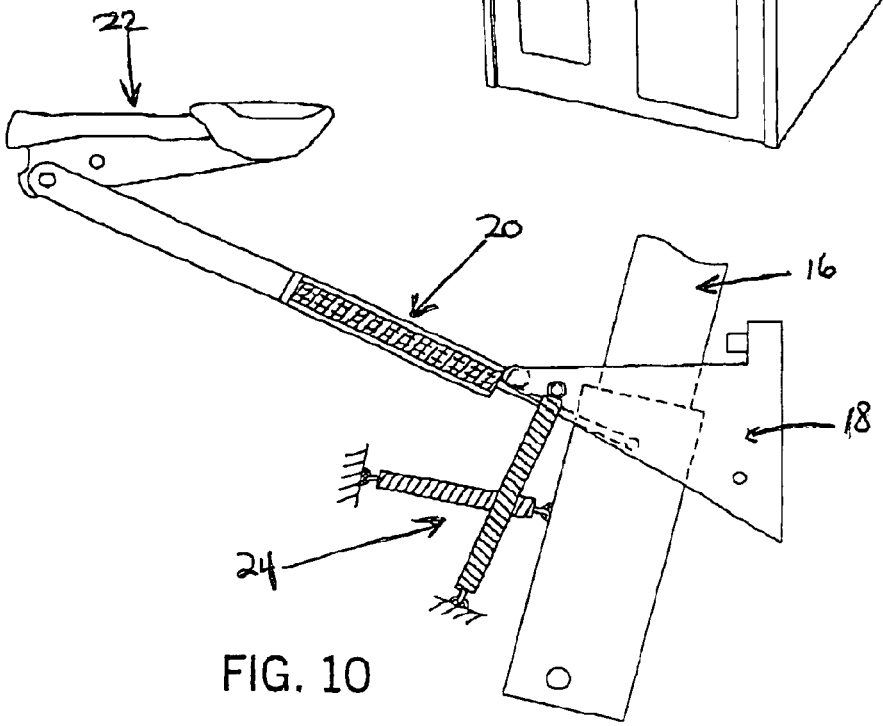
FIG. 10

COIN CATAPULT DEVICE FOR USE IN AN AMUSEMENT GAME

CROSS REFERENCE TO RELATED APPLICATION

This application is based on and claims priority from U.S. Provisional Patent Application Ser. No. 60/451,798 filed Mar. 4, 2003.

FIELD OF THE INVENTION

The present invention generally relates to a coin catapult device for use in an amusement game in which objects are projected toward various targets within an enclosed playing area, and specifically an amusement game in which the catapult receives coins and projects the coins toward scoring targets. The present invention more specifically relates to a coin catapult that includes a lever arm that controls the amount of force applied to the catapult to control the distance an object or coin is projected.

BACKGROUND OF THE INVENTION

Various amusement games are known in which a player tosses or projects objects toward various targets. Such games typically employ a catapult device or launching mechanism designed with different actuators, pivot arms, force transmitting components, belts, control rods and the like to hurl a projectile with certain forces over different distances.

It remains desirable to provide a catapult device or launcher which can be used to flip or shoot objects, such as coins, ping pong balls, tennis balls and baseballs, through the air with a force designed for that particular application. Such catapult device should be flexible enough to be adapted for use in small applications, such as arcade redemption games, or more demanding applications, such as tennis ball serving or baseball pitching machines. In addition, the catapult device should be capable of providing consistent and reliable high cycle operation with a minimum of maintenance requirements.

SUMMARY OF THE INVENTION

It is a general object of the present invention to provide a catapult device for propelling objects towards a target.

It is also an object of the present invention to provide a catapult device which utilizes the release of a compressed spring force to launch an object from a pivot arm.

It is a further object of the present invention to provide a catapult device which is capable of catapulting various objects.

It is an additional object of the present invention to provide a catapult device employing a unique motion translation arrangement.

Another object of the present invention is to provide a catapult device which is designed to endure substantially continuous operation with a minimum of service required.

In one aspect of the invention, a catapult device is provided for hurling objects towards a target. The catapult device includes a support structure and a pivot bracket pivotally mounted on the support structure and provided with a bearing arrangement. A lever arm is pivotally connected to the support structure and is engageable with the pivot bracket. A spring-biased motion translation arrangement is coupled to the lever arm and is engageable with the bearing arrangement on the pivot bracket. A pivot arm is pivotally secured to the support structure and the motion translation arrangement, the pivot arm being provided with a receiver for holding an object to be hurled. A pivotal movement of the lever arm develops a spring force in the motion translation arrangement and enables the pivot bracket to pivot such that the motion translation arrangement moves along the bearing arrangement and releases the spring force causing the pivot arm to swing and hurl the object.

In the preferred embodiment, the support structure includes a pair of parallel support panels held separated from each other by spacer structure. The pivot bracket includes a first adjustable stop for limiting movement of the lever arm in a first direction. The pivot bracket also includes a pair of parallel side plates mounted externally of the support panels. The pivot bracket is provided with an end block for mounting the bearing arrangement. The bearing arrangement is preferably comprised of a set of ball bearings. The lever arm is mounted for pivotal movement between the support panels and the side plates. The lever arm is engageable with a second adjustable stop mounted between the support panels for limiting movement of the lever arm in a second direction. The motion translation arrangement includes a spring retainer having parallel sidewalls, an intermediate endwall and a closed endwall spaced from the intermediate endwall. The spring retainer defines a spring cavity therein. A trigger rod extends between the lever arm and the spring retainer, and is received in the spring cavity. The trigger rod has an enlarged end located in the spring cavity, and an opposite connection end pivotally joined to the lever arm. A compression spring surrounds the trigger rod and extends between the enlarged end of the trigger rod and the closed endwall of the spring retainer. The closed endwall is engageable with the bearing arrangement on the pivot bracket. The trigger rod runs beneath the bearing arrangement. The compression spring is compressible between the enlarged end of the trigger rod, and the closed endwall of the spring retainer as the lever arm is moved to define the spring force. An end of the spring retainer opposite the closed endwall is pivotally attached to the pivot arm. A first return spring is attached between the lever arm and the support structure. A second return spring is attached between the pivot bracket and the support structure. A locking rod is selectively engaged with the support structure to prevent movement of the lever arm.

In another aspect of the invention, a catapult device is provided for hurling objects toward a target. The catapult device includes a support structure and a pivot bracket pivotally mounted on the support structure and provided with a bearing arrangement. A lever arm is pivotally connected to the support structure between a rest position and an operating position, the lever arm being engageable with the pivot bracket. A spring retainer has parallel sidewalls with an open end, a closed endwall spaced from the open end and an intermediate endwall between the open end and the closed endwall. The closed endwall is engageable with the bearing arrangement, and the spring retainer defines a spring cavity therein. A trigger rod extends between the lever arm and the spring retainer, and is received in the spring cavity. The trigger rod has an enlarged end located in the spring cavity and an opposite connection end pivotally joined to the lever arm. A compression spring surrounds the trigger rod and extends between the enlarged end of the trigger rod and the closed endwall of the spring retainer. A pivot arm is pivotally secured to the support structure and to the open end of the spring retainer, the pivot arm having a receiver for holding an object to be hurled. A return spring arrangement is connected between the support structure and the lever arm, and between the support structure and the pivot bracket. The return spring arrangement includes an adjustment device. A solenoid assembly is attached to the support structure and includes a locking rod for preventing movement of the lever arm from the rest position.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of an amusement game employing the catapult device of the present invention;

FIG. 10 is a schematic view of the catapult device.

DETAILED DESCRIPTION OF THE INVENTION

Figure 2:
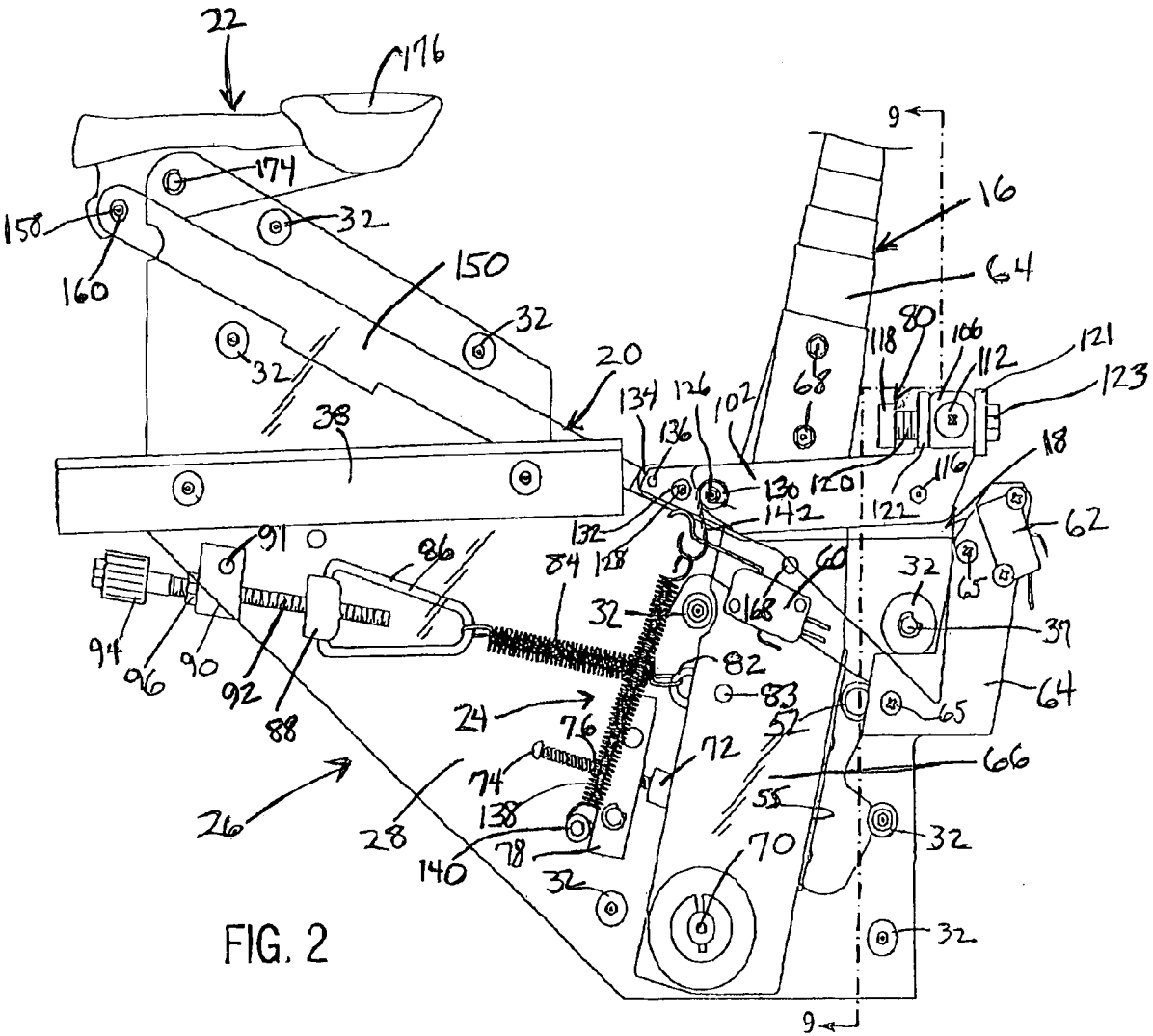
FIGS. 2, 3 and 4 are side views of the catapult device in various operating positions thereof, FIG. 2 being taken on line 2—2 of FIG. 1.

Referring now to the drawings, FIG. 1 illustrates an automated amusement game 10 employing a catapult device 12 of the present invention for launching projectiles, such as coins or tokens, towards a target 14.

As initially seen schematically in FIG. 10, the catapult device 12 is generally comprised of a lever arm 16, a pivot bracket 18, a motion translation arrangement 20, a pivot arm 22 and a return spring system 24.

With further reference to FIGS. 2, 5, 8 and 9, the catapult device 12 has a support structure 26 which is adaptively mounted within the amusement game 10. The support structure 26 includes a pair of parallel support panels 28, 30 which are preferably constructed of a transparent plastic or plexiglas material. The support panels 28, 30 are held separated apart by a series of spacers 32 which are retained between the panels 28, 30 by bolts 34 and nuts 36 or other pin retainers 37.

Figure 8:
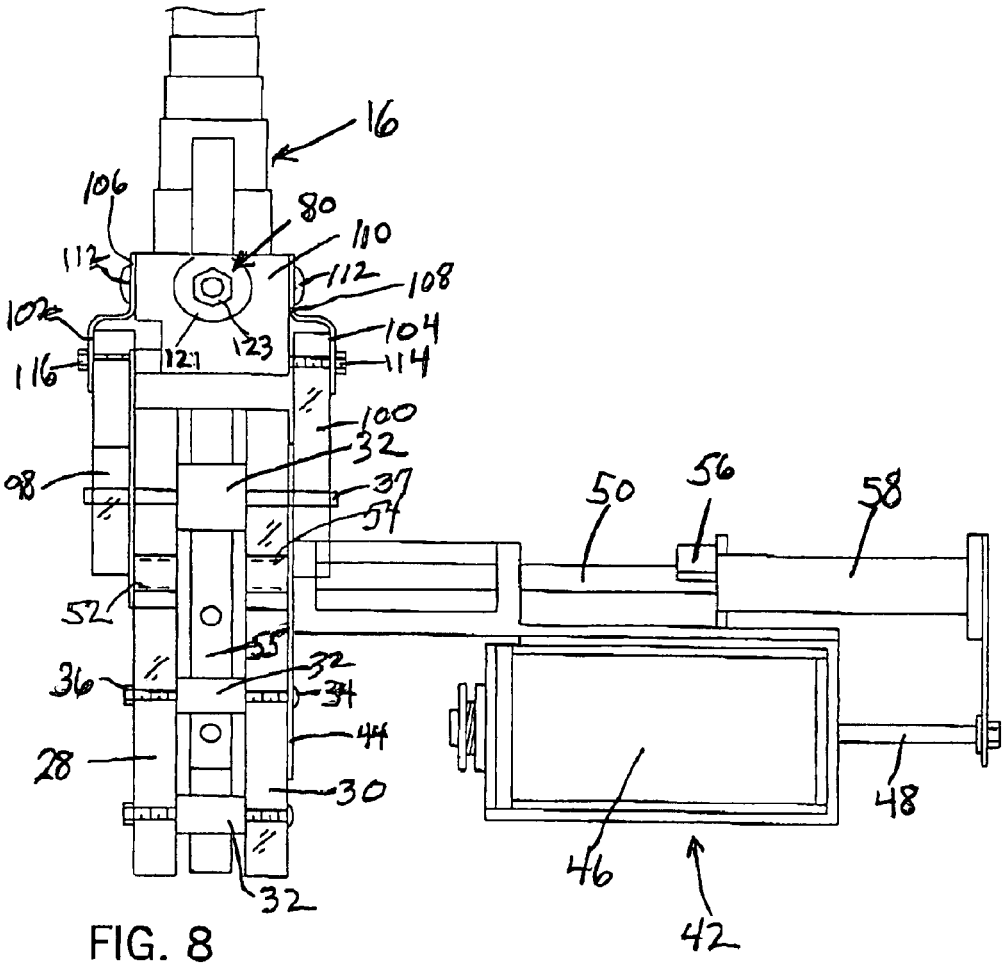
FIG. 8 is a partial rear view of the catapult device.
Figure 9:
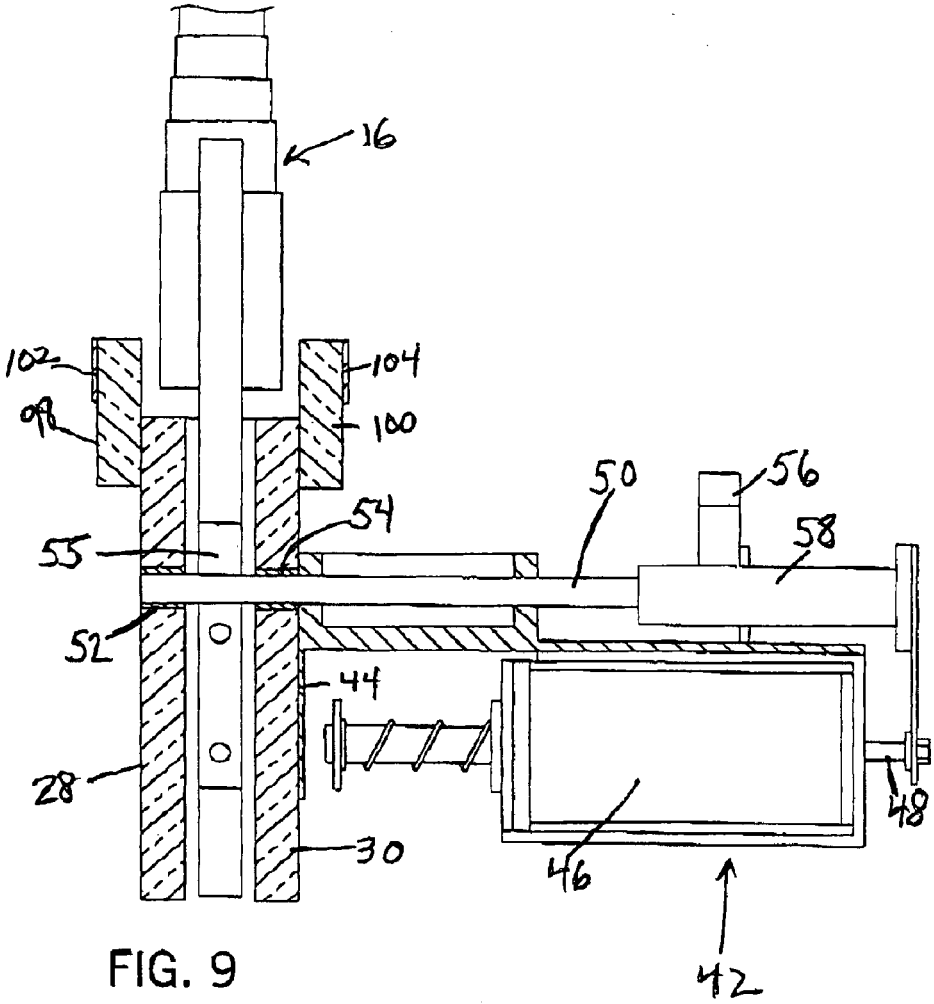
FIG. 9 is a rear view in partial cross section similar to FIG. 8 showing a locking mode for the catapult device.

A pair of elongated attachment brackets 38, 40 is secured outside the support panels 28, 30 to facilitate further installation of the device 12 within the amusement game 10. As best seen in FIGS. 8 and 9, a solenoid assembly 42 is connected externally to the support panel 30 by a mounting plate 44. The solenoid assembly 42 includes a solenoid 46 having a moveable plunger 48, one end of which is linked to a retractable and extendable locking rod 50. The solenoid 46 acts to selectively move the locking rod 50 into and out of engagement with a pair of retaining sleeves 52, 54 secured in the support panels 28, 30. FIG. 8 shows the locking rod 50 in retracted position to allow movement of the lever arm 16. FIG. 9 depicts the locking rod 50 in extended position to prevent movement of the lever arm 16. The locking rod 50 moves across a guide strip 55 fixed to the rear of the lever arm 16. A pivoting latch 56 is engageable with an enlarged portion 58 of the locking rod 50 when it is desired to hold the rod 50 in the retracted position of FIG. 8. A first microswitch 60 is attached directly to the support panel 28 and responds to movement at a forward end of pivot bracket 18. A second microswitch 62 is fixed on a bracket 64 joined by fasteners 65 to the support panel 28 and responds to movement at a rearward end of the pivot bracket 18. The microswitches 60, 62 are operatively connected with operational and display components of the amusement game 10.

Figure 3:
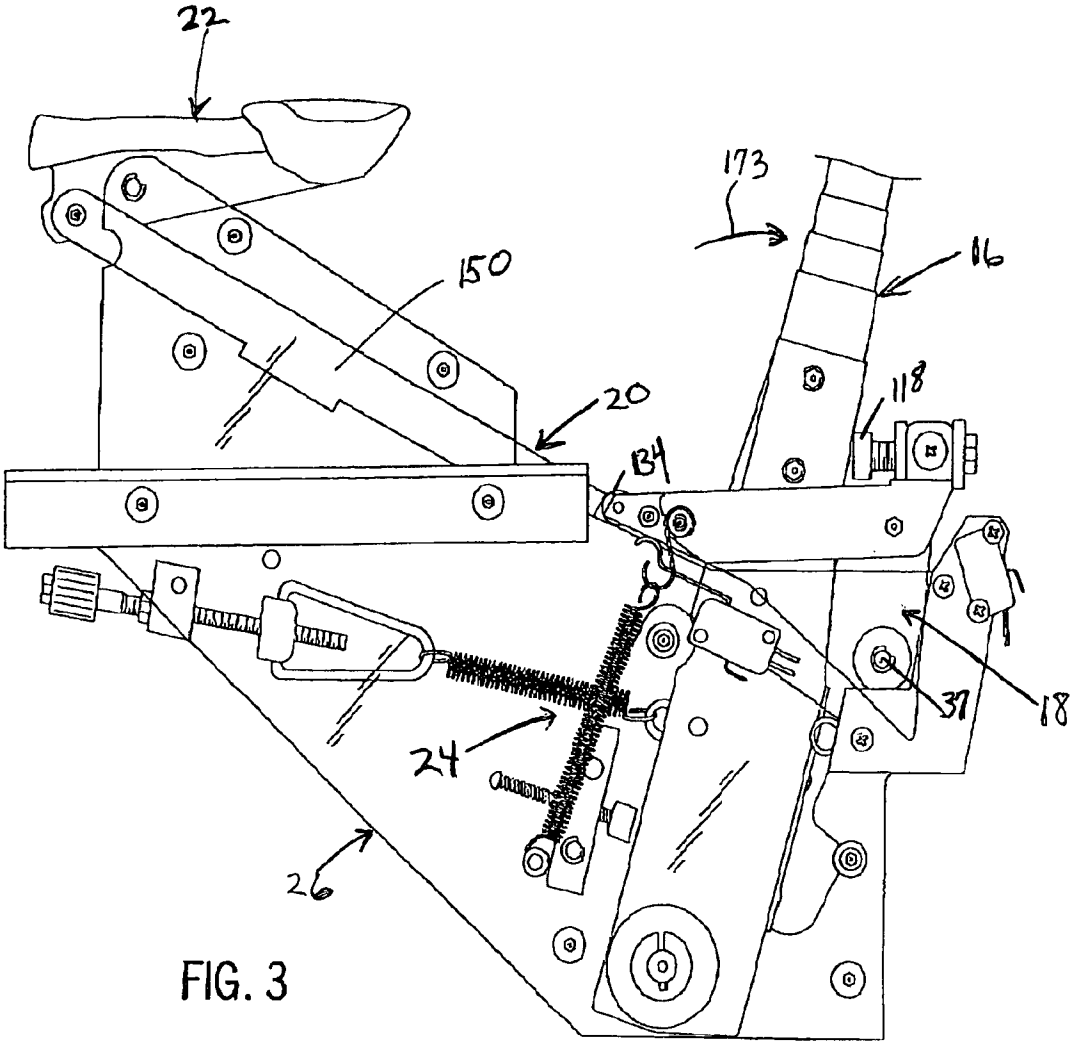
Figure 4:
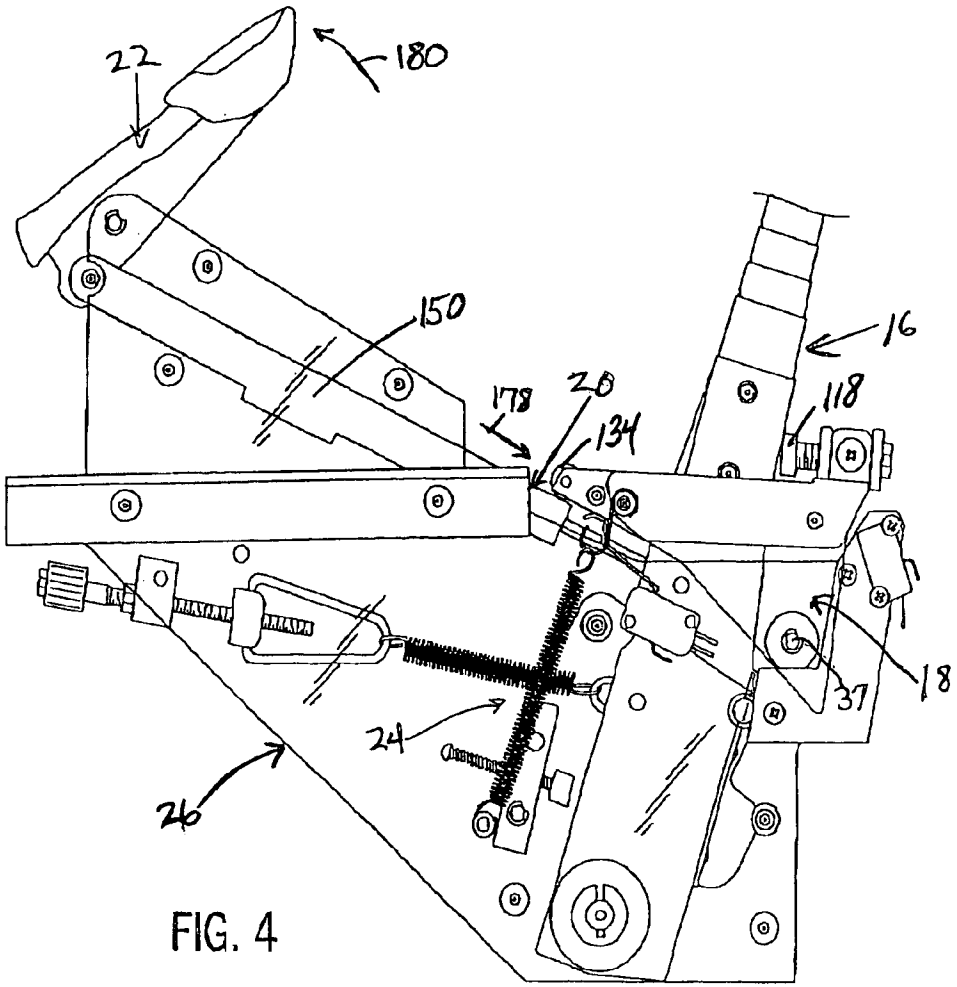

FIGS. 2–4 illustrate the lever arm 16 having an upper cylindrical portion 64 which receives and is connected to a lower bar portion 66 by fasteners 68. The lower bar portion 66 is pivotally secured at 70 between the support panels 28, 30 so that the lever arm 16 is moveable back and forth over a predetermined range. Forward movement of the lever arm 16 is limited by an adjustable stop 72 mounted on the end of a spring-surrounded screw 74. The screw 74 is received by a nut 76 on a retaining bar 78 fixed between the support panels 28, 30. Rearward movement of the lever arm 16 is restricted by an adjustable contact member 80 at the top, rear portion of the pivot bracket 18 as will be further detailed below. The front of the lower bar portion 66 has an eyehook 82 which receives part of the return spring system 24. The eyehook 82 is retained inside the lower bar portion 66 of lever arm 16 by a retainer pin 83. The return system 24 includes a coil spring 84, a holder 86 having a first block 88, a second block 90 fixed by pin retainers 91 between support panels 28, 30 and an elongated adjustment screw 92 having a rotatable, knurled knob 94. Coil spring 84 has one end received by the eyehook 82 and an opposite end engaged with the holder 86. Screw 92 is threadably received in a nut 96 on second block 90 and freely passes through an aperture in the first block 88. All the components 84–96 lie between the support panels 28, 30 and are used to regulate the return force on the moveable lever arm 16. It should be understood that manipulation of the knob 94 will alter the tension of spring 84 as desired for a particular application.

As best illustrated in FIGS. 2, 8 and 9, the pivot bracket 18 is constructed of a pair of triangularly-shaped, parallel sideplates 98, 100 fabricated preferably from transparent plastic or plexiglas. The sideplates 98, 100 are pivotally mounted to the fixed support panels 28, 30 about pin retainer 37. Extending along the upper rear portions of the sideplates 98, 100 is a pair of release brackets 102, 104 having upper extensions 106, 108. A mounting block 110 carrying the adjustable contact member 80 is positioned between the side plates 98, 100 and extensions 106, 108 at the rear of the pivot bracket 18. Screws 112 fasten the extensions 106, 108 to the mounting block 110 at the top, and an elongated screw 114 passes through the mounting block 110 at the bottom, and is held in place by a nut 116. The contact member 80 includes an adjustable stop 118 on the end of a screw 120 provided with a first rotatable, knurled ring 121. A second knurled ring 122 is rotatably positioned on screw 120 behind stop 118. The ring 121 is prevented from being removed from screw 120 by a nut 123. The screw 120 is threadably received on the mounting block 110 so that rotation of ring 121 or 122 will establish the position of stop 118 to limit rearward travel of lever arm 16. An end block 124 (FIG. 5) is positioned between the sideplates 98, 100 at the front of the pivot bracket 18, and held fixed in place by elongated screws 126, 128. Screw 126 passes through the release brackets 102, 104 on sideplates 98, 100 and through the end block 124, and is retained by a pair of nuts, one being seen at 130. Screw 128 passes through sideplates 98, 100 and through end block 124, and is retained by a nut 132. End block 124 has a recess for pivotally mounting a set of ball bearings 134 (FIG. 5) on a pin 136 extending across the end block 124. As shown in FIG. 2, the return spring system 24 also includes a coil spring 138 having a lower end connected to a retainer 140 extending outwardly from support panel 28. An upper end of a spring 138 is engaged with an S-hook 142 looped over screw 126 behind nut 130. The spring 138 assists in returning the pivot bracket 18 to its original position.

Figure 5:
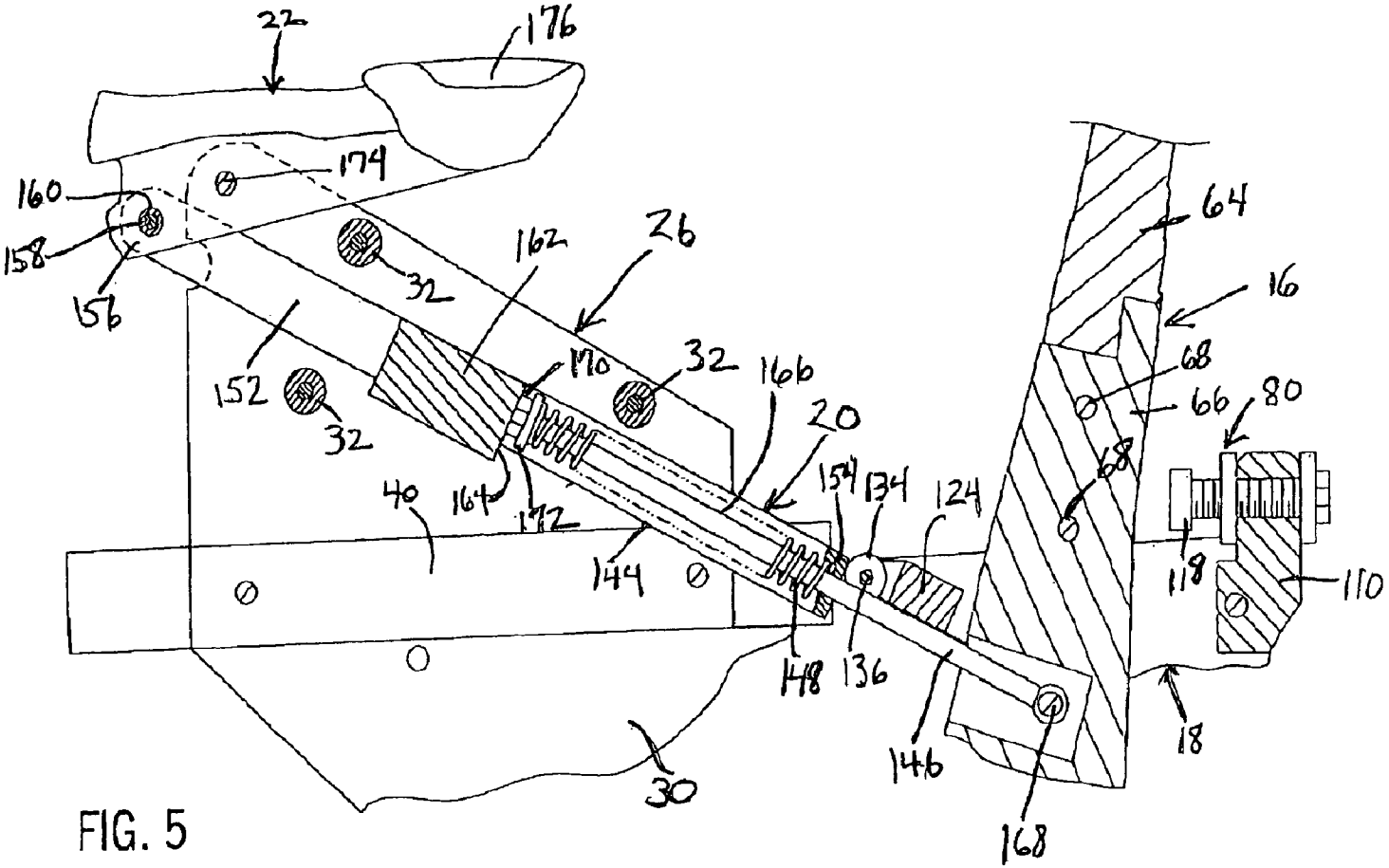
FIGS. 5, 6 and 7 are enlarged, fragmentary side views in partial cross section corresponding to FIGS. 2, 3 and 4.

Referring to FIG. 5, the motion translation arrangement 20 includes a spring retainer 144, an elongated trigger rod 146 and a compression spring 148. The spring retainer 144 has a pair of parallel, metallic sidewalls 150, 152, having a closed rearward endwall 154 which is engaged with the ball bearings 134, and an open end 156 which is pivotally secured to the pivot arm 22 by a screw 158 and a nut 160. A medial portion of the spring retainer 144 is provided with a fixed block 162 which defines an intermediate endwall 164. A lower portion of the spring retainer 144 defines a spring cavity 166 which extends between the endwalls 154, 164. The trigger rod 146 normally extends between the lever arm 16 and the intermediate endwall 164 and is moveable with respect thereto. A rearward end of trigger rod 146 is pivotally mounted to the lower bar portion 66 of lever arm 16 by a pin 168. The trigger rod 146 runs beneath the ball bearings 134 and extends upwardly and forwardly into spring cavity 166 terminating in a nut 170 normally engaged with intermediate endwall 164. The compression spring 148 surrounds the trigger rod 146 and extends between the closed endwall 154 of the spring retainer 144 and a washer 172 encircling the rod 146 and abutting the nut 170. As lever arm 10 is pulled rearwardly as shown by arrow 173 in FIG. 6, the spring 148 is compressed against the closed endwall 154 of the spring retainer 144.

The pivot arm 22 is pivotally mounted for swinging motion to the top, forward end of the support panels 28, 30 by means of a pivot pin 174. A rearward end of the pivot arm 22 includes a receiver 176 for holding an object, such as a coin, which is to be hurled, launched, or catapulted forwardly towards a target. In the preferred embodiment of the invention, the receiver 176 is positioned to receive a coin from a chute arrangement such that when the catapult device 12 is used in an amusement/arcade game, a coin deposited by the user is placed on the receiver 176. The receiver 176 can have a variety of styles depending upon the object to be launched. For example, the receiver 176 may be a spoon-like or cup-like device or a simple paddle. The receiver 176 can be designed to swing up at a variety of speeds, distances or angles, or can be made to push an object forward without swinging motion.

Figure 6:
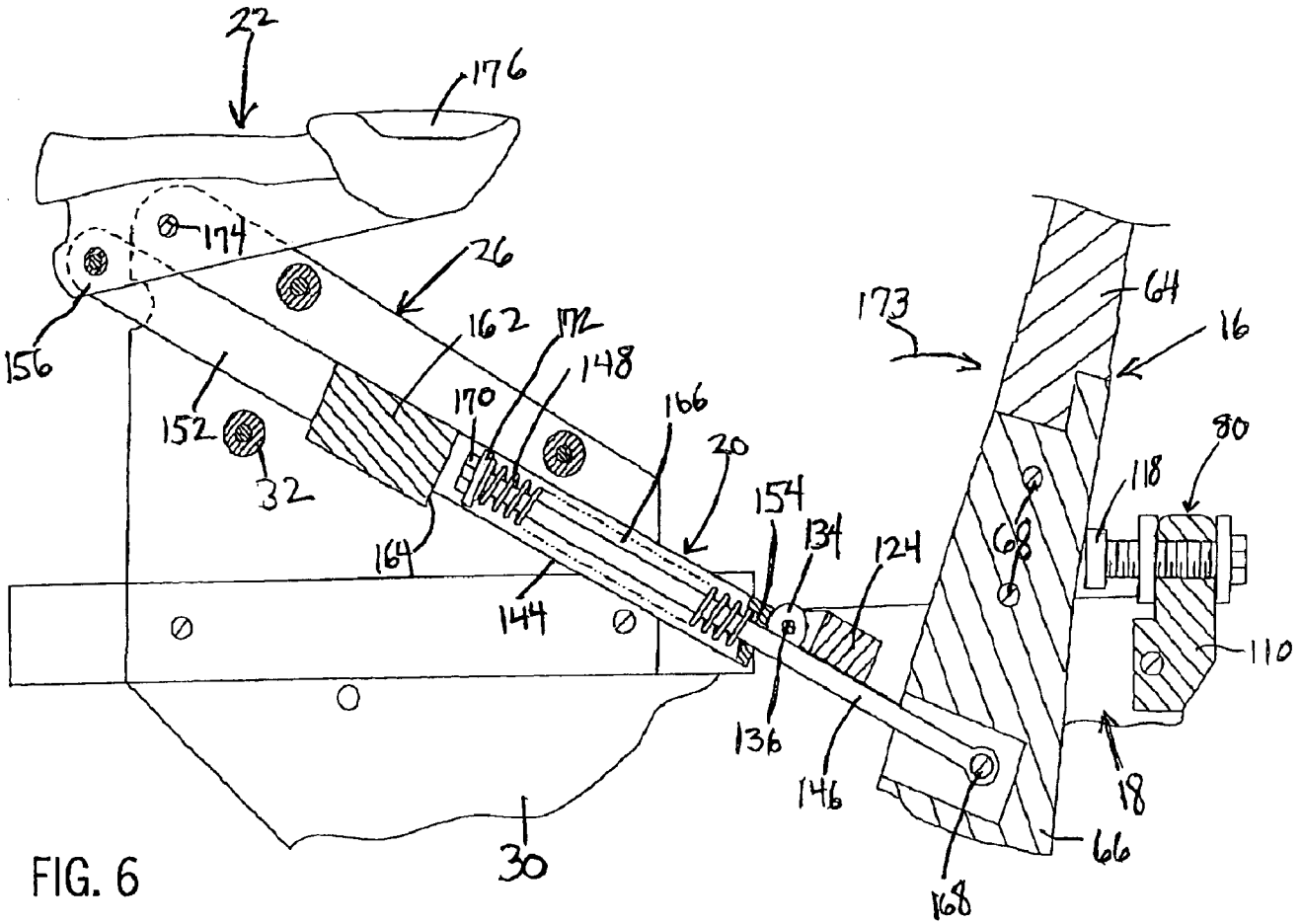
Figure 7:
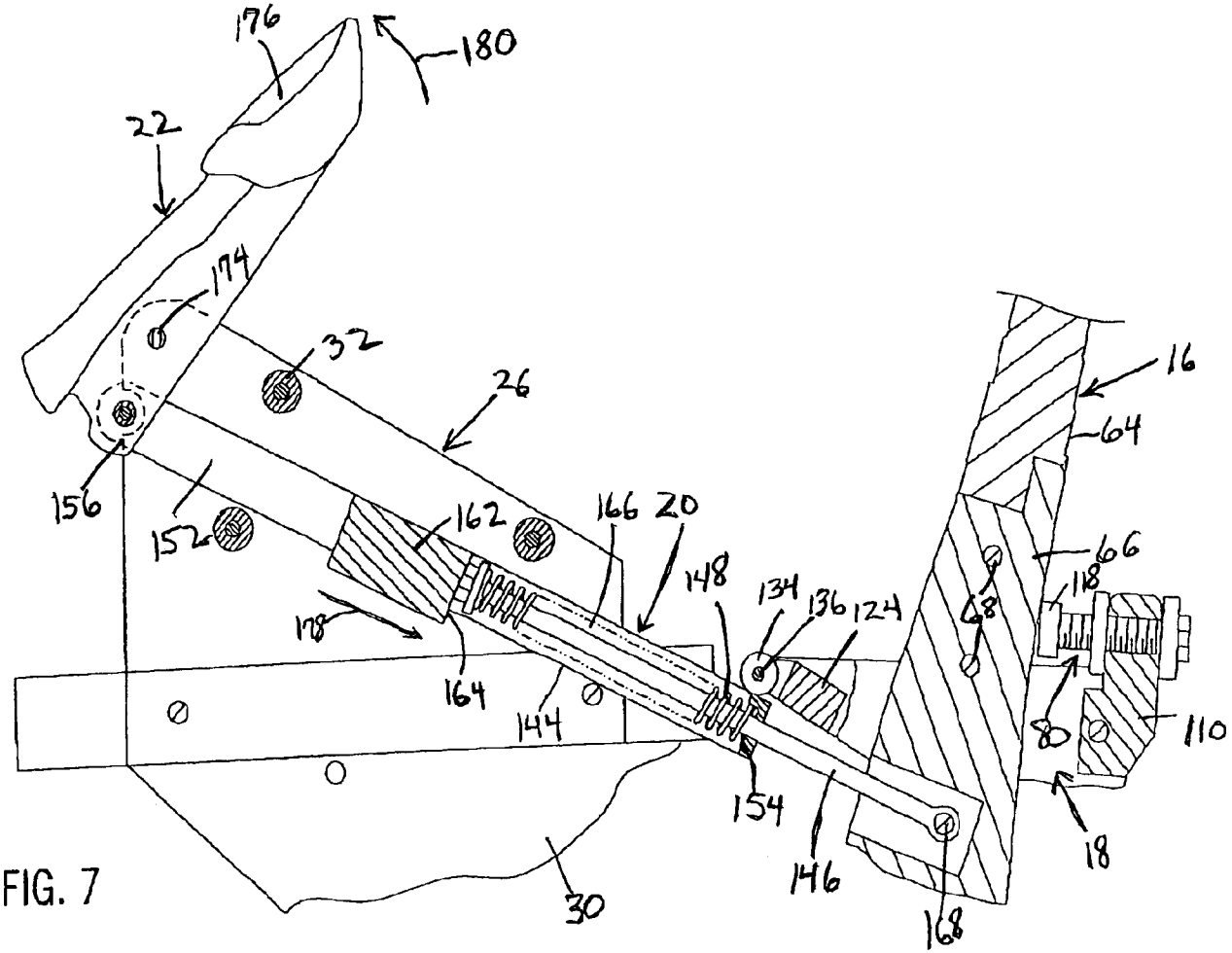

The launching action of the catapult device 12 will now be described. With the locking rod 50 in retracted position as seen in FIG. 8, the lever arm 16 is free to be actuated. FIGS. 2 and 5 represent the starting or rest position of the catapult device 12. FIGS. 3 and 6 represent movement of the lever arm 16 towards stop 118. When the lever arm 16 is initially pulled rearwardly, as shown by arrow 173 in FIG. 6, the spring 148 is compressed against endwall 154 by movement of trigger rod 146, and return spring 84 is tensioned as depicted in FIG. 3. FIGS. 4 and 7 represent the resulting motion caused by contact of stop 118 by lever arm 16. Upon the lever arm 16 contacting stop 118, the triangular pivot bracket 18 pivots upwardly about pin 37 tensioning return spring 138. As pivot bracket 18 pivots, the ball bearings 134 supported in end block 124 are pivoted upwardly and away from endwall 154 of spring retainer 144 as shown in both FIGS. 4 and 7. When the ball bearings 134 pivot upward, the bias force on the compressed spring 148 is released, and causes the spring retainer 144 to forcefully move in the direction of arrow 178. The movement of the spring retainer 144 causes the pivot arm 22 with receiver 176 to swing upward as shown by arrow 180 so that a coin in the receiver 176 is catapulted towards a target. Once the application force is removed from lever arm 16, return spring 84 then pulls lever arm 16 forwardly until stop 72 is contacted. At the same time, return spring 138 relocates pivot bracket 18 to its original position shown in FIGS. 2 and 5 so that ball bearings 134 again contact endwall 154 of spring retainer 144. At this point, the catapult device 12 is ready to be actuated again.

Although the trigger rod 146 is pulled back in the preferred embodiment by the lever arm 16, it is contemplated that other means may be used depending on the specific application. The range of the catapult device 12 is controlled primarily by the strength of the compression spring 148, but it is also affected by the length of the pivot arm 22, the weight of the object being thrown and the angle at which the object is launched. While the invention has been described in terms of catapulting a coin, it should be understood that the catapult device 12 can be designed to shoot, hurl, launch or pitch other objects such as ping pong balls, tennis balls and baseballs.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

I claim:

1. A catapult device for hurling objects towards a target comprising:

a support structure;

a pivot bracket pivotally mounted on the support structure and provided with a bearing arrangement;

a lever arm pivotally connected to the support structure and engageable with the pivot bracket;

a spring-biased, motion translation arrangement coupled to the lever arm and engageable with the bearing arrangement on the pivot bracket; and a pivot arm pivotally secured to the support structure and the motion translation arrangement, the pivot arm being provided with a receiver for holding an object to be hurled, whereby pivotal movement of the lever arm develops a spring force in the motion translation arrangement and enables the pivot bracket to pivot such that the motion translation arrangement moves along the bearing arrangement and releases the spring force causing the pivot arm to swing and hurl the object.

2. The catapult device of claim 1, wherein the support structure includes a pair of parallel support panels held separated from each other by a spacer structure.

3. The catapult device of claim 2, wherein the pivot bracket includes a pair of parallel sideplates mounted externally of the support panels.

4. The catapult device of claim 3, wherein the lever arm is mounted for pivotal movement between the support panels and the sideplates.

5. The catapult device of claim 2, wherein the lever arm is engageable with a second adjustable stop mounted between the support panels for limiting movement of the lever arm in a second direction.

6. The catapult device of claim 1, wherein the pivot bracket includes a first adjustable stop for limiting movement of the lever arm in a first direction.

7. The catapult device of claim 1, wherein the pivot bracket is provided with an end block for mounting the bearing arrangement.

8. The catapult device of claim 1, wherein the bearing arrangement is comprised of a set of ball bearings.

9. The catapult device of claim 1, wherein the motion translation arrangement includes a spring retainer having parallel sidewalls, an intermediate endwall and a closed endwall spaced from the intermediate endwall, the spring retainer defining a spring cavity therein;

a trigger rod extending between the lever arm and the spring retainer and received in the spring cavity, the trigger rod having an enlarged end located in the spring cavity and an opposite connection end pivotally joined to the lever arm; and a compression spring surrounding the trigger rod and extending between the enlarged end of the trigger rod and the closed endwall of the spring retainer.

10. The catapult device of claim 9, wherein the closed endwall is engageable with the bearing arrangement on the pivot bracket.

11. The catapult device of claim 9, wherein the trigger rod runs beneath the bearing arrangement.

12. The catapult device of claim 9, wherein the compression spring is compressible between the enlarged end of the trigger rod and the closed endwall of the spring retainer as the lever arm is moved to define the spring force.

13. The catapult device of claim 9, wherein an end of the spring retainer opposite the closed endwall is pivotally attached to the pivot arm.

14. The catapult device of claim 1, wherein a first return spring is attached between the lever arm and the support structure.

15. The catapult device of claim 1, wherein a second return spring is attached between the pivot bracket and the support structure.

16. The catapult device of claim 1, wherein a locking rod is selectively engaged with the support structure to prevent movement of the lever arm.

17. A catapult device for hurling objects towards a target comprising:

a support structure;

a pivot bracket pivotally mounted on the support structure and provided with a bearing arrangement;

a lever arm pivotally connected to the support structure between a rest position and an operating position, the lever arm being engageable with the pivot bracket;

a spring retainer having parallel sidewalls with an open end, a closed endwall spaced from the open end and an intermediate endwall between the open end and the closed endwall, the closed endwall being engageable with the bearing arrangement, the spring retainer defining a spring cavity therein;

a trigger rod extending between the lever arm and the spring retainer and received in the spring cavity, the trigger rod having an enlarged end located in the spring cavity and an opposite connection end pivotally joined to the lever arm;

a compression spring surrounding the trigger rod and extending between the enlarged end of the trigger rod and the closed endwall of the spring retainer; and a pivot arm pivotally secured to the support structure and to the open end of the spring retainer, the pivot arm having a receiver for holding an object to be hurled.

18. The catapult device of claim 17, including a return spring arrangement connected between the support structure and the lever arm, and between the support structure and the pivot bracket.

19. The catapult device of claim 18, wherein the return spring arrangement includes an adjustment device.

20. The catapult device of claim 17, wherein a solenoid assembly is attached to the support structure and includes a locking rod for preventing movement of the lever arm from the rest position.

* * * * *